US005377610A

United States Patent [19]

Goebel

[11] Patent Number: 5,377,610

[45] Date of Patent: Jan. 3, 1995

[54] SAILBOAT BRAKE APPARATUS

[76] Inventor: Clarence F. Goebel, R.R. 1, Ruthville, Minot, N. Dak. 58701

[21] Appl. No.: 852,300

[22] Filed: Mar. 16, 1992

[51] Int. Cl.[6] ..... B63H 25/34

[52] U.S. Cl. ..... 114/145 R; 114/282

[58] Field of Search ..... 440/38, 43; 188/2 R; 114/145 A, 145 R, 39.1, 39.2, 343, 364, 162, 163, 274, 280, 282

[56] References Cited

U.S. PATENT DOCUMENTS 2,199,333 4/1940 Dunklin ..... 114/145 R
3,159,134 12/1964 Winnen ..... 114/145 R
3,626,887 12/1971 Schutt ..... 114/145 R

*Primary Examiner*—Joseph F. Peters, Jr.
*Assistant Examiner*—Clifford T. Bartz
*Attorney, Agent, or Firm*—Leon Gilden

[57] ABSTRACT

A brake apparatus includes a plurality of brake plates mounted to lower end portions of gear shaft members to permit displacement and rotation of the brake plates from a first position orthogonally oriented relative to a stern plate of a sailboat to a second position in parallel relationship to the stern plate of the sailboat. A housing mounted to an interior surface of the sailboat adjacent an interior surface of the stern plate is arranged to house a control lever therewithin forwardly of a rudder control rod.

1 Claim, 6 Drawing Sheets

SAILBOAT BRAKE APPARATUS

BACKGROUND OF THE INVENTION

1. Field of the Invention

The field of invention relates to sailboat apparatus, and more particularly pertains to a new and improved sailboat brake apparatus wherein the same is arranged to effect braking of a sailboat to enhance ease of steerage and control thereof.

2. Description of the Prior Art

In manipulation of a sailboat, an operator is subject to prevailing wind conditions and finds steerage and control awkward at times. To overcome deficiencies, the instant invention attempts to provide for braking plates mounted to the stern plate in convenient proximity to a rudder of the sailboat.

Prior art braking structure for vessels is illustrated in the U.S. Pat. No. 1,574,718 to Westendarp utilizing a room-like structure arranged rearwardly of a propeller to minimize propulsion of the propeller in use.

U.S. Pat. No. 2,544,642 to Abbott sets forth a similar structure mounted rearwardly of a rudder of a power boat.

The U.S. Pat. Nos. 3,561,392 to Baez; 1,257,165 to Westendarp; and U.S. Pat. No. 4,278,040 to Doeriffer, et al. are further examples of braking structure mounted rearwardly of a power boat propeller.

As such, it may be appreciated that there continues to be a need for a new and improved sailboat brake apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of sailboat apparatus now present in the prior art, the present invention provides a sailboat brake apparatus wherein the same is arranged to effect selective braking of forward propulsion of a sailboat during use. As such, the general purpose of the present invention, which will be described subsequently in greater detail, is to provide a new and improved sailboat brake apparatus which has all the advantages of the prior art sailboat brake apparatus and none of the disadvantages.

To attain this, the present invention provides a brake apparatus including a plurality of brake plates mounted to lower end portions of gear shaft members to permit displacement and rotation of the brake plates from a first position orthogonally oriented relative to a stern plate of a sailboat to a second position in parallel relationship to the stern plate of the sailboat. A housing mounted to an interior surface of the sailboat adjacent an interior surface of the stern plate is arranged to house a control lever therewithin forwardly of a rudder control rod.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sailboat brake apparatus which has all the advantages of the prior art sailboat brake apparatus and none of the disadvantages.

It is another object of the present invention to provide a new and improved sailboat brake apparatus which may be easily and efficiently manufactured and marketed.

It is a further object of the present invention to provide a new and improved sailboat brake apparatus which is of a durable and reliable construction.

An even further object of the present invention is to provide a new and improved sailboat brake apparatus which is susceptible of a low cost of manufacture with regard to both materials and labor, and which accordingly is then susceptible of low prices of sale to the consuming public, thereby making such sailboat brake apparatus economically available to the buying public.

Still yet another object of the present invention is to provide a new and improved sailboat brake apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
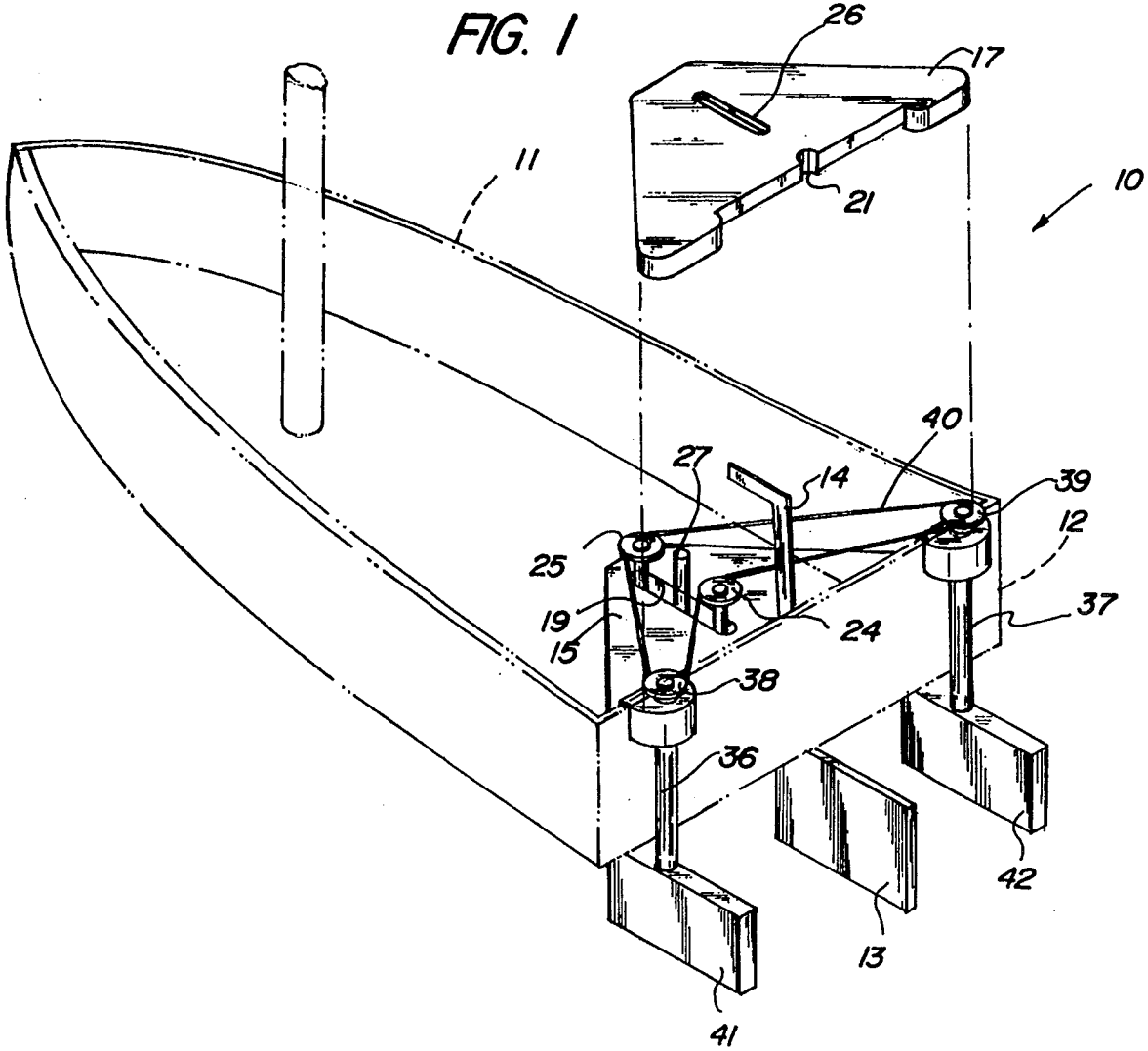
FIG. 1 is an isometric illustration of the instant invention.
Figure 2:
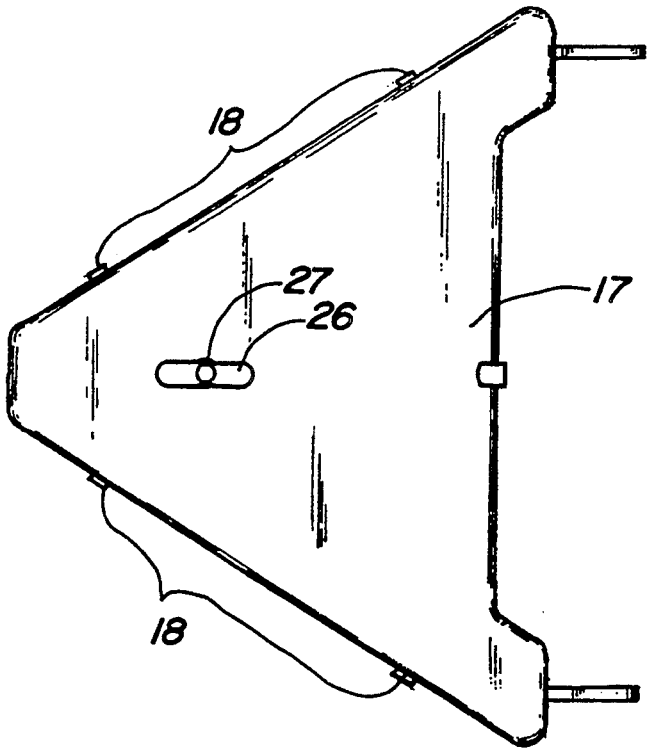
FIG. 2 is an orthographic top view of the instant invention.
Figure 3:
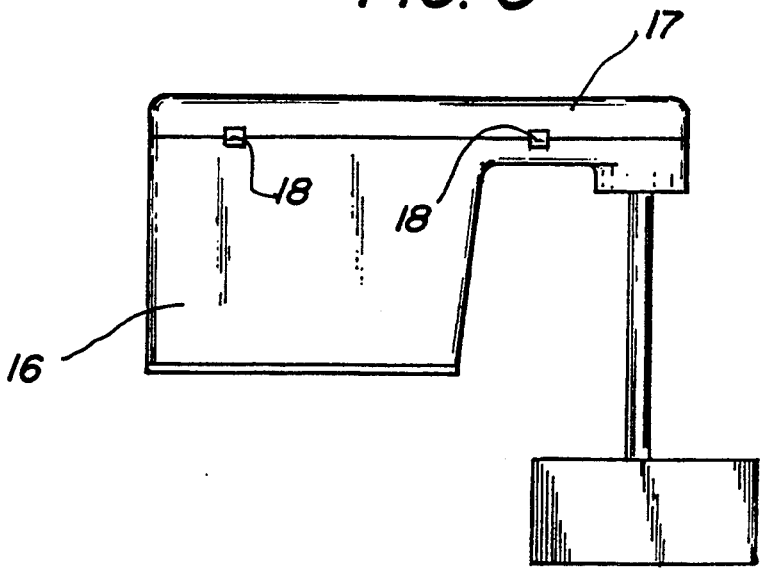
FIG. 3 is an orthographic side view of the housing structure of the invention, as set forth in FIG. 2.

With reference now to the drawings, and in particular to FIGS. 1 to 8 thereof, a new and improved sailboat brake apparatus embodying the principles and concepts of the present invention and generally designated by the reference numeral 10 will be described.

More specifically, the sailboat brake apparatus 10 of the instant invention essentially comprises the organization mounted within a sailboat hull 11, as illustrated in FIG. 1, to include a stern plate 12. A rudder blade 13 is mounted below the stern plate 12, with a rudder control rod 14 pivotally mounting a rudder blade 13 at a lower end of the control rod 14 positioned below the stern plate 12. A housing 16 includes an upper housing plate 15 spaced from and parallel to a lower housing plate 15*a* (see FIG. 5). A housing cover lid 17 is arranged for securement to overlie the housing and the upper housing plate 15 to include fasteners 18 mounted about the periphery of the lid 17 about upper distal end portions of the side wall of the housing 16, in a manner as indicated in the FIG. 3.

An upper plate slot 19 orthogonally oriented relative to the stern plate 12 is directed through the top plate, with the upper plate 15 including an upper plate rear edge 20 positioned adjacent to the interior surface of the stern plate 12 formed with a recess 21 medially thereof to receive the rudder control rod 14 therewithin.

A first gear shaft 22 and a second gear shaft 23 are arranged in a parallel spaced relationship relative to one another orthogonally directed through and secured rotatably within the upper and lower plates 15 and 15*a*. A first gear 24 is mounted at an upper end of the first gear shaft 22 and a second gear 25 mounted at an upper end of the second gear shaft 23, wherein the first and second gears 24 and 25 are arranged in a substantially coplanar relationship. A lid slot 26 directed through the housing cover lid 17 is positioned over the upper plate slot 19 that is directed longitudinally between the first and second gear shafts 22 and 23. A brake control rod 27 orthogonally directed through the first and second slots 19 and 26 is arranged parallel to and between the first and second gear shafts 22 and 23. A first link plate 28 (see FIG. 5) orthogonally mounted to a lower distal end of the brake control rod 27 includes a first rod 29 orthogonally mounted to and extending below the first link plate 28 as the first rod 29 is arranged parallel relative to the brake control rod 27. The first rod 29 includes a second link plate 30 and an intermediate link plate 32 mounted to the lower distal end of the first rod 29, with the second link plate 30 fixedly mounted to the first gear shaft and the intermediate link plate 32 pivotally mounted to a third link plate 31 spaced from the second link plate 32 as the third link plate 31 is fixedly mounted to the second gear shaft 23. Displacement of the brake control rod 27 within the upper plate slot 19 effects selective rotation of the first and second gears 24 and 25 in opposite directions as it should be noted that the second link plate 30 is positioned on opposed side of the slots 19 and 26 relative to the third link plate 31 to effect the counter rotation of the respective first and second gears 24 and 25. The endless drive belt 40 is directed about the first and second gears 24 and 25, as well as the third and fourth gears 38 and 39 mounted to upper distal ends of the third and fourth gear shafts 36 and 37. The third and fourth gear shafts are in turn rotatably mounted to the stern plate 12 and extend therebelow terminating in respective first and second bracket plates 41 and 42. To effect braking of the sailboat hull 11, the bracket control rod 27 is displaced to effect rotation of the third and fourth gears 38 and 39 to orient the first and second brake plates 41 and 42 in a generally parallel relationship relative to the stern plate 12 from the first position, as illustrated in FIG. 1, orthogonally oriented relative to the stern plate 12.

Figure 7:
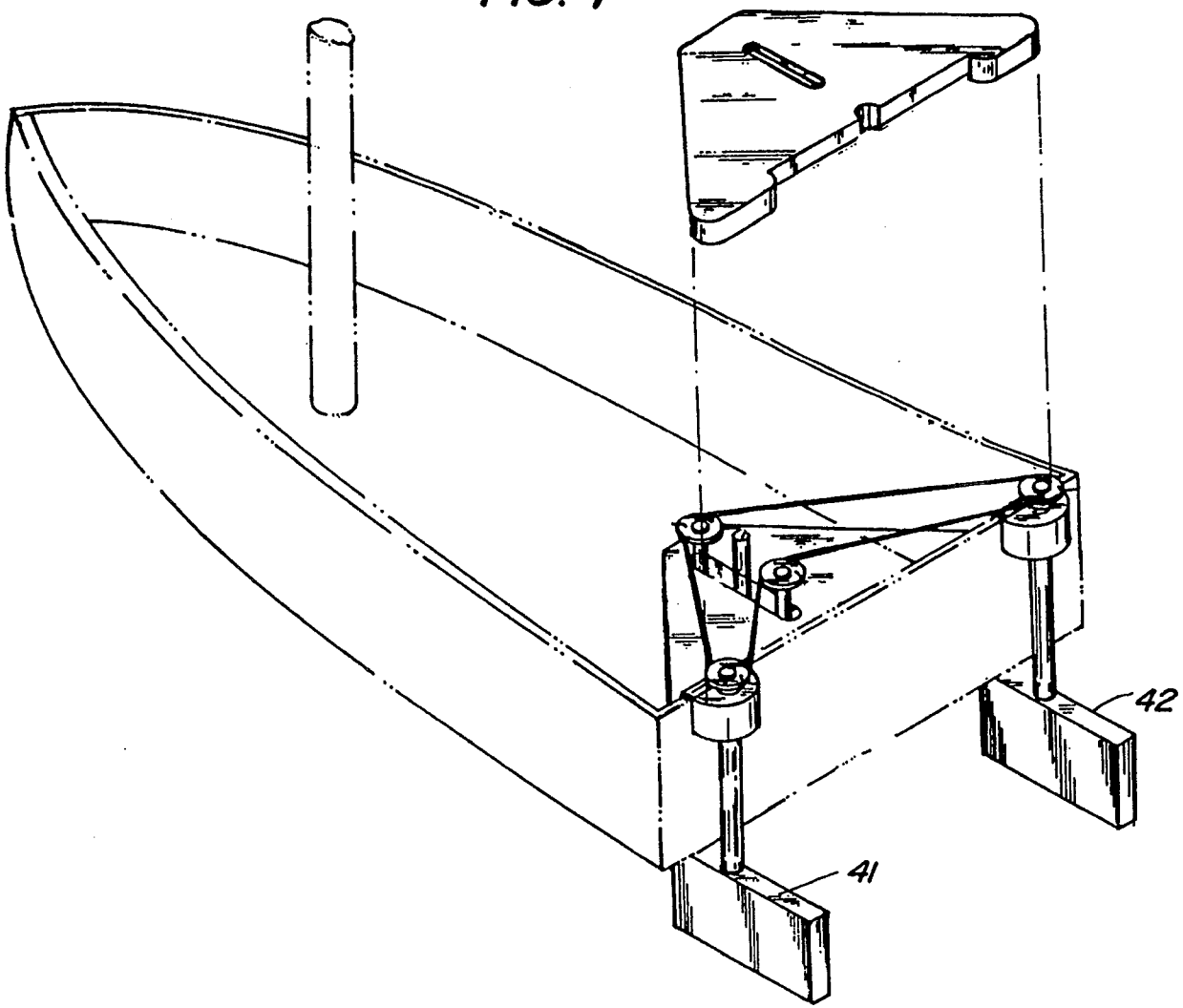
FIG. 7 is an isometric illustration of the instant invention without the intermediate rudder structure utilizing the brake plates as a rudder mechanism.

FIG. 7 illustrates the use of the brake plates 41 and 42 utilized without the rudder 13 as the plates serve as a rudder mechanism in use.

Figure 4:
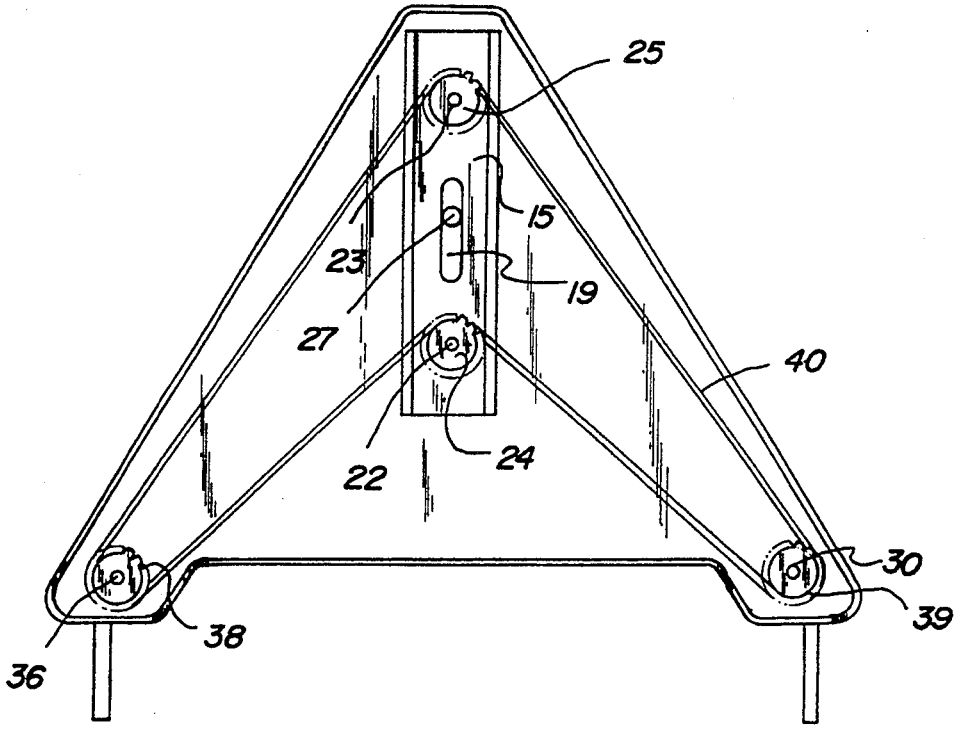
FIG. 4 is an orthographic view of the housing with the lid removed therefrom.
Figure 5:
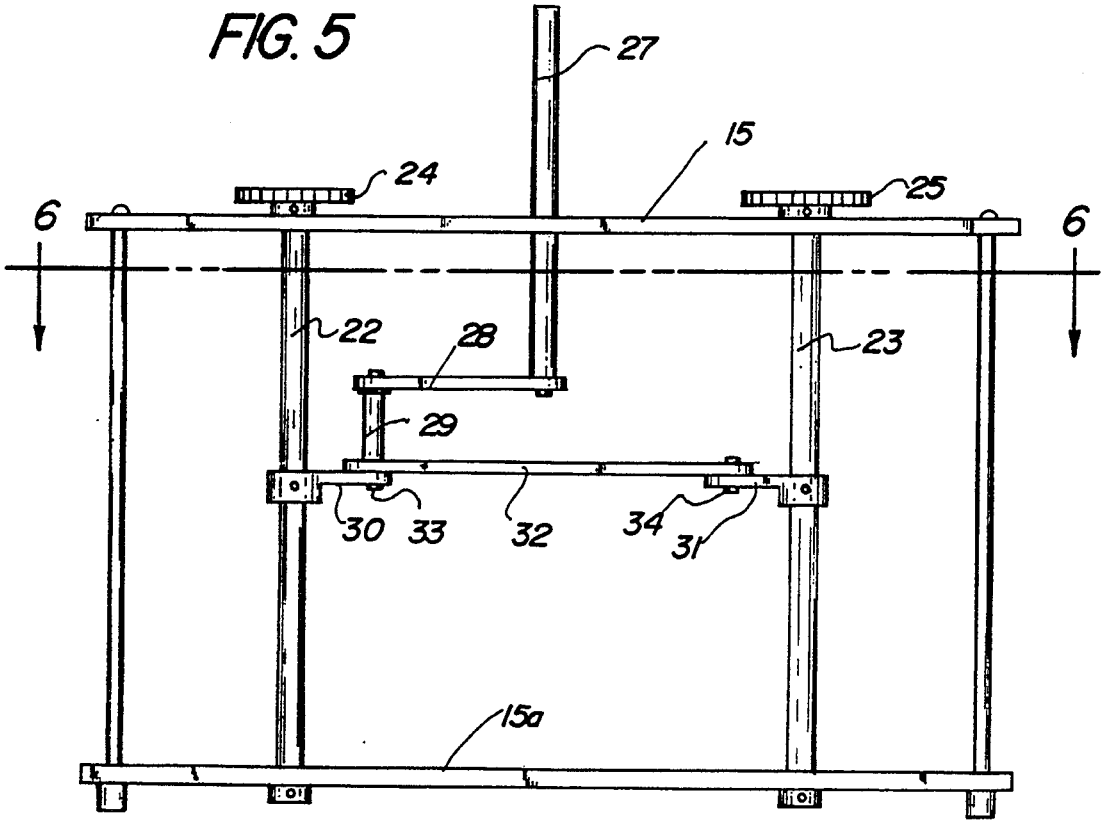
FIG. 5 is an orthographic view of the linkage structure utilized in the invention, taken in elevation.
Figure 6:
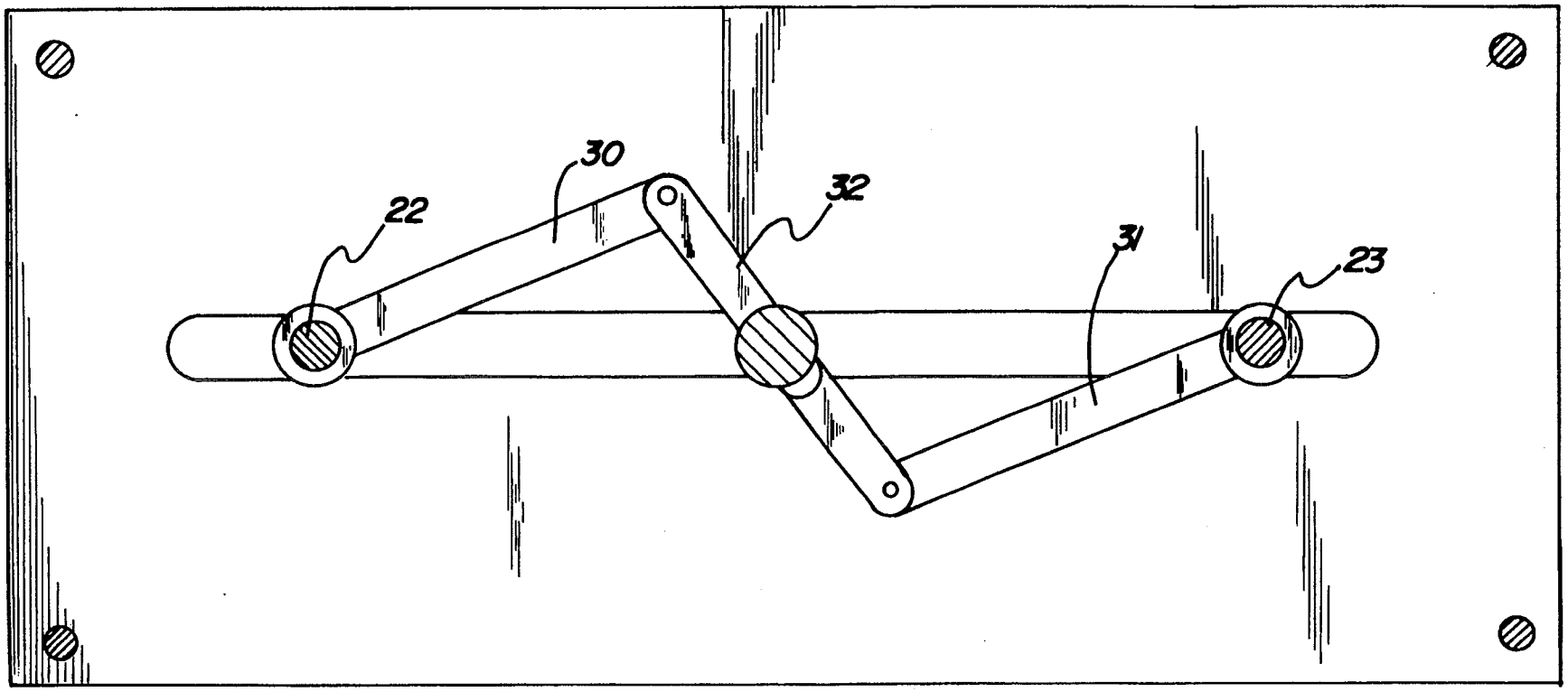
FIG. 6 is an orthographic top view of a modified linkage structure utilized by the invention.
Figure 8:
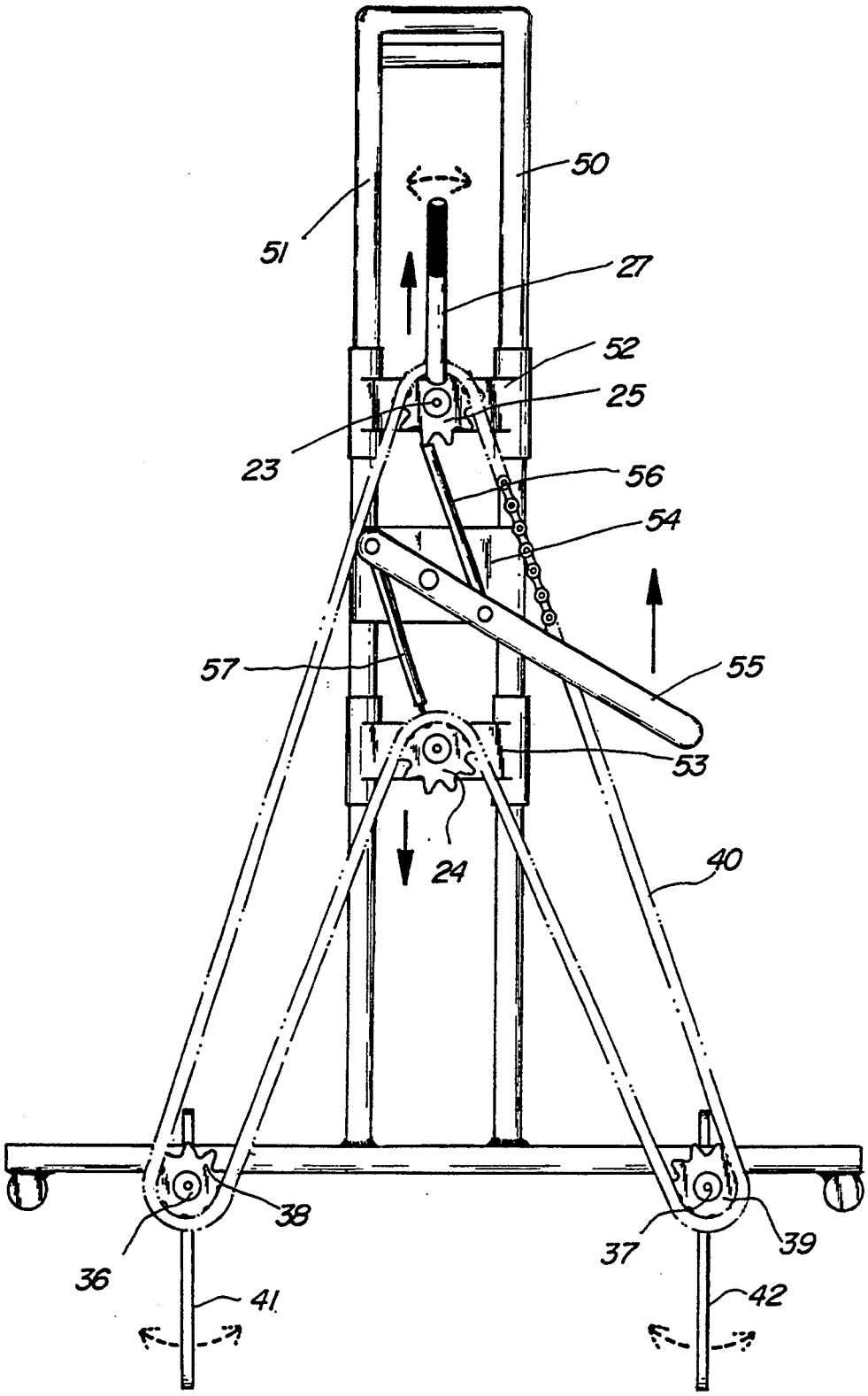
FIG. 8 is an orthographic top view of a further brake control mechanism utilized by the invention.

The FIG. 8 illustrates a steerage control system employing the assembly as illustrated in lieu of the organization as typified in the FIGS. 4 and 5. In this aspect of the invention, the gears and their associated shafts are arranged in a manner as illustrated and described above, but wherein a first slide bar 50 is mounted relative to and parallel a second slide bar 51 in a coextensive relationship. A first slide plate 52 is mounted to the slide bars 50 and 51, with a second slide bar 53 positioned adjacent the first and second brake plates positioned in slidable relationship relative to the first and second slide bars, as illustrated. A stationary plate 54 is positioned medially of the first and second slide plates 52 and 53, and includes a tension lever 55 pivotally mounted relative to the stationary plate, with a respective first and second slide link 56 and 57 pivotally mounted to the tension lever 55, wherein the first and second slide links 56 and 57 are in turn mounted to the respective first and second slide plates 52 and 53 to effect tensioning of the organization. The drive belt 40 is indicated as an endless chain member to insure cooperation relative to the gear structure. The control rod 27 is fixedly mounted to the second gear 25, whereupon rotation of the second gear 25 effects simultaneous pivotment of the first and second brake plates 41 and 42 for directional braking and control of the associated water craft.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sailboat brake apparatus, comprising, a sailboat hull, the sailboat hull including a stern plate, and a rudder control rod extending below the sailboat hull adjacent the stern plate, and the rudder control rod including a rudder blade mounted to a lower end of the rudder control rod, and a housing member mounted within the sailboat hull adjacent the stern plate, with the housing including an upper housing plate spaced from a loner housing plate, and a cover lid arranged for securement to an upper distal end of the housing above the upper housing plate, with the lid including a lid slot, the upper plate including an upper plate slot coextensive with and parallel the lid slot, and a brake control rod orthogonally oriented relative to the upper housing plate and lower housing plate extending through the upper plate slot and the lid slot, and a first brake plate spaced from a second brake plate, with the first brake plate and the second brake plate positioned below the sailboat hull and adjacent the stern plate and positioned on opposed sides of the rudder blade, and drive means in operative communication between the brake control rod and the first brake plate and the second brake plate for effecting pivotment of the first brake plate and the second brake plate from a first position orthogonally oriented relative to the stern plate to a second position arranged parallel relative to one another and the stern plate, and the drive means includes a first gear shaft and a second gear shaft directed through the lid slot and the upper plate slot, with the brake control rod connected to the second gear shaft, and the first gear shaft including a first gear at an upper distal end of the first gear shaft, and a second gear fixedly mounted to an upper distal end of the second gear shaft, with the first gear and the second gear arranged substantially coplanar relative to one another, and a third gear shaft mounted adjacent the stern plate, with the third gear shaft including the first brake plate mounted to a lower distal end of the third gear shaft, and a fourth gear shaft, with the second brake plate mounted to a lower distal end of the fourth gear shaft, and a third gear mounted to an upper distal end of the third gear shaft, and a fourth gear mounted to an upper distal end of the fourth gear shaft, and a first slide bar arranged in a parallel coextensive relationship relative to a second slide bar, wherein the first slide bar and the second slide bar are mounted within a housing member orthogonally oriented relative to the stern plate, and a first slide plate slidably mounted between the first and second slide bars, and a second slide plate slidably mounted between the first and second slide bars, the first slide bar orthogonally and rotatably mounting the first gear shaft therethrough, and a second slide plate slidably mounted relative to the first and second slide bars orthogonally mounting the second gear shaft therethrough, and a stationary plate fixedly mounted between the first and second slide bars oriented between the first and second slide plates, the stationary plate including a tension lever pivotally mounted relative to and above the stationary plate, the tension lever including a first slide link and a second slide link, the first slide link mounted to the tension lever and the first slide plate, the second slide link pivotally mounted to the tension lever and the second slide plate, whereupon pivotment of the tension lever effects tensioning of the drive means.

* * * * *